United States Patent [19]

Hall

[11] Patent Number: 4,587,524

[45] Date of Patent: May 6, 1986

[54] REDUCED HEIGHT MONOPOLE/SLOT ANTENNA WITH OFFSET STRIPLINE AND CAPACITIVELY LOADED SLOT

[75] Inventor: Edward A. Hall, St. Louis, Mo.

[73] Assignee: McDonnell Douglas Corporation, St. Louis, Mo.

[21] Appl. No.: 569,265

[22] Filed: Jan. 9, 1984

[51] Int. Cl.[4] ..... H01Q 13/18

[52] U.S. Cl. ..... 343/729; 343/767

[58] Field of Search ..... 343/725, 729, 767

[56] References Cited

U.S. PATENT DOCUMENTS 4,443,802 4/1984 Mayes ..... 343/729

*Primary Examiner*—Eli Lieberman

*Attorney, Agent, or Firm*—Rogers, Howell, Moore & Haferkamp

[57] ABSTRACT

A reduced height monopole/slot antenna having generally parallel spaced ground planes, the upper one of which has a slot therein, a stripline located between the ground planes, and a monopole extending from the stripline through said slot generally orthogonally through the upper ground plane and being top hat loaded at the outer end thereof. The stripline is offset toward the slotted ground plane, and the slot is capacitively loaded with capacitance connected across the narrow dimension of the slot.

9 Claims, 8 Drawing Figures

FIG. 1
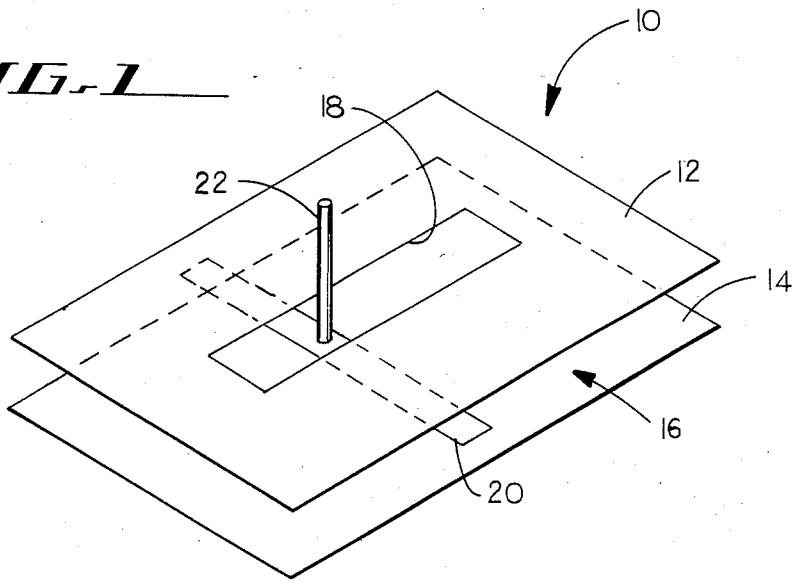
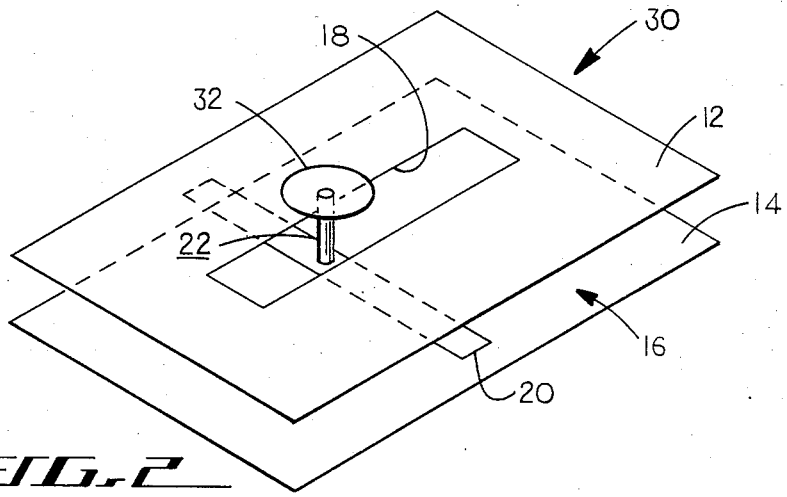
FIG. 2
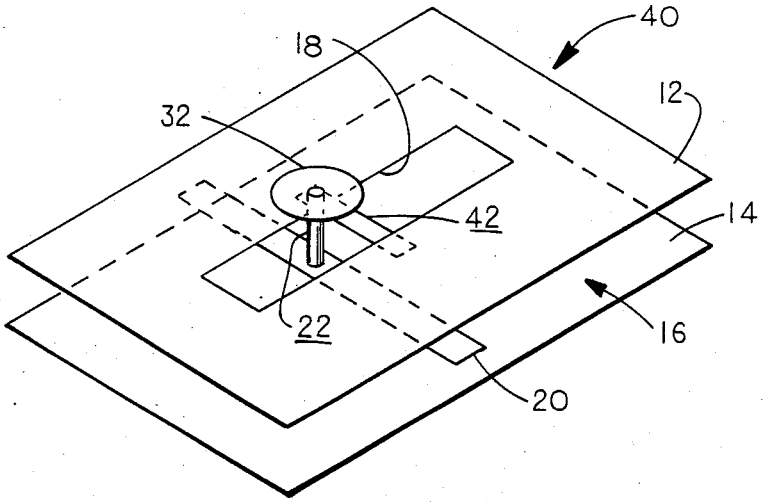
FIG. 3

REDUCED HEIGHT MONOPOLE/SLOT ANTENNA WITH OFFSET STRIPLINE AND CAPACITIVELY LOADED SLOT

BACKGROUND AND SUMMARY OF THE INVVENTION

This invention relates to monopole/slot antennas, and more particularly such antennas where the height of the monopole is reduced by the addition of compensating features.

By way of background, monopole/slot antennas (also referred to herein as full height monopole/slot antennas) are well known in the art. Such antennas are characterized as including a radiating slot fed by a stripline and backed by a cavity. The cavity is formed by upper and lower ground planes with conductive fasteners, posts, or the like around its perimeter. the fasteners act as shorting pins, forming the cavity walls, and preventing the parallel wave guide mode of radiation from the edges of the ground planes. Thus, the ground planes and shorting pins define the cavity. The upper ground plane has a slot therein, and a stripline is located midway between the ground planes. A monopole extends from the stripline and through the center of the radiating slot, orthogonal to the upper ground plane. The monopole is excited by directly contacting the stripline feed. Typically, suitable terminals are provided with such antennas to excite one end of the stripline and load the other.

With monopole/slot antennas of this type, the resonant frequency is determined by the monopole and slot dimensions. Because it is desirable to eliminate cavity influence on the antenna, the cavity dimensions typically are chosen so its lowest resonant frequency is considerably above the antenna operating range. The characteristic impedance of the antenna is determined in part by the width of the stripline and the thickness of the cavity.

the design of such monopole/slot antennas is well known in the art. Thus, for a given desired frequency range, resonant frequency, and characteristic impedance, the dimensions of the cavity, stripline width, slot, and monopole may be easily determined from known handbooks or known calculations.

Monopole/slot antennas of this type have several desirable operating characteristics. Because the monopole and slot are representative of reciprocal structures (electric dipole versus magnetic monopole), complementary tuning effects result that broaden the overall impedance bandwidth. The monopole/slot antenna develops a highly directive cardioid radiation pattern in the antenna ground plane with a deep null maintained over a wide bandwidth and occuring in the direction of the loaded end of the stripline. This cardioid pattern results from the superposition of the monopole and slot patterns. The monopole radiates a uniform pattern with constant phase in the ground plane direction. The slot radiates a figure 8 pattern with a 180° phase shift between lobes. The deepest null occurs when the monopole and slot are excited equally. Because the radiation patterns of the monopole and slot element do not change appreciably as they become "electrically short", the combined monopole/slot antenna maintains a good cardioid radiation pattern over a wide frequency range.

While the monopole/slot antenna has many advantages, it has a principle disadvantage. The monopole protrudes above the antenna body. Its height is nearly one quarter wave length at the antenna's center frequency, which is nearly 3 inches (7.62 cm) at one GHz. Moreover, the monopole is a wire or rod, and must be protected by a radome in most installations. However, in some applications, no protrusions from the mounting surface can be tolerated, and therefore in those applications the full height monopole/slot antenna cannnot be used.

A known modification of the full height monopole/-slot antenna is known as the hybrid slot antenna. Such an antenna is described in a technical paper entitled "The Hybrid Slot, a Versatile Low-Profile Radiator With Small Reflection Coefficient" by Mayes and Cwik, Electrical Engineering Department, University of Illinois, the entirety of which is incorporated by reference. A discussion of monopole/slot antennas may be found in the technical paper entitled, "The Monopole-Slot: A Small Broad Band Unidirectional Antenna", by Mayes, Warren, and Wiesenmeyer, IEEE Trans., AP-20 No. 4, pages 489–493, July, 1972, the entirety of which is incorporated by reference. With the hybrid slot antenna, the height of the monopole is reduced by top loading. This top loading is accomplished by providing a disk or "top hat" at the top of the monopole such that the larger the disk, the greater the loading. While the advantage of top hat loading is to reduce the height of the monopole, thus overcoming the chief disadvantage of the full height monopole/slot antenna, such top loading produces certain undesirable characteristics by sacrificing electrical performance when the monopole height is reduced. Specifically, with the hybrid slot antenna, there is a sacrifice in impedance bandwidth and radiation pattern performance.

The present invention substantially overcomes the disadvantages of the full height monopole/slot antenna without significant sacrifice in impedance, bandwidth, and radiation patterns. Thus, with the present invention the height of the monopole is substantially reduced while maintaining the impedance and cardioid radiation characteristics over a wide bandwidth. This is accomplished by offsetting the stripline toward the slotted ground plane, and capacitively loading the slot. The reduced height monopole/slot antenna of the present invention is a wide bandwidth antenna that develops a highly directive cardioid radiation pattern. It has low volume, excellent form factor, and easy producibility. The wide bandwidth occurs as a low input VSWR over an extremely wide frequency range, and a cardioid pattern in the antenna ground plane with a deep null is maintained over a wide bandwidth. The monopole element of the present invention, which protrudes above the antenna in the full height monopole/slot antenna, is significantly reduced in height by electrical loading. Therefore, for many applications, the antenna of the present invention can be flush mounted with no protrusions above the mounting surface. Like the monopole/-slot antenna, the reduced height antenna of the present invention eliminates the problem of changing element impedances as frequency changes. It has a very wide bandwidth of nearly constant input impedance.

Thus, with the antenna of the present invention, the height of the monopole is greatly reduced. Moreover, through the other modifications, it retains the excellent electrical characteristics of the full height monopole/-slot antenna with the added advantages of a low profile. These modifications give the antenna performance that is considerably improved for many applications over those previously known.

BRIEF DESCRIPTION OF THE DRAWINGS

FIG. 1 is a schematic showing a monopole/slot antenna of the prior art;

FIG. 2 is a schematic showing a top hat loaded monopole/slot antenna of the prior art;

FIG. 3 is a schematic of a reduced height monopole/-slot antenna of the present invention;

DETAILED DESCRIPTION OF A PREFERRED EMBODIMENT

Figure 4:
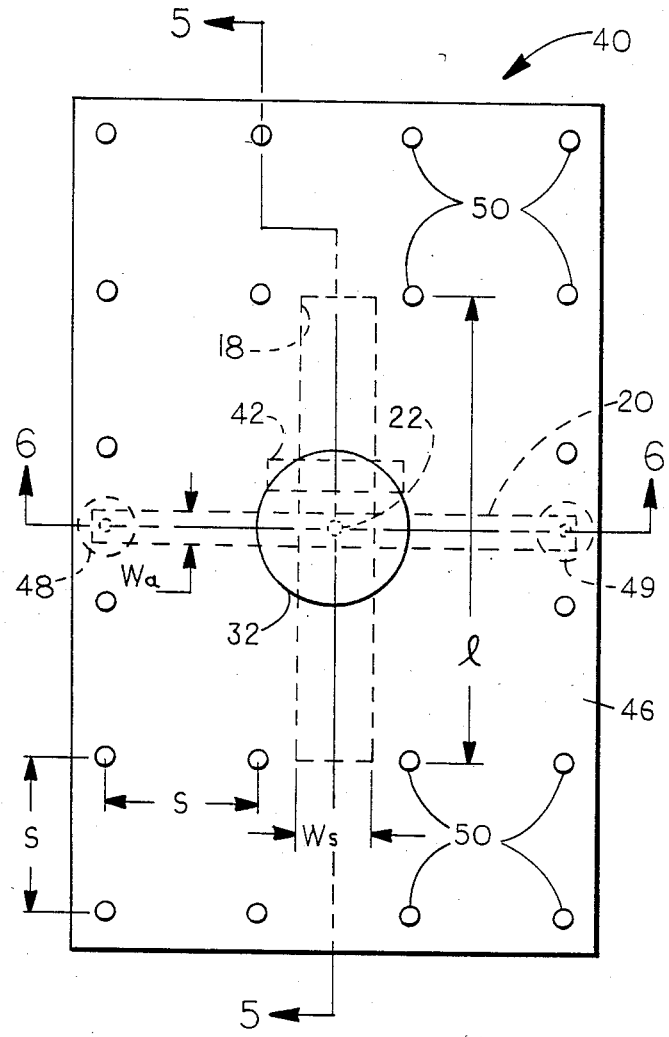
FIG. 4 is a plan view of a reduced height monopole/-slot antenna of the present invention in somewhat more detail as shown in FIG. 3.

With reference to FIG. 1 of the drawing, the full height monopole/slot antenna 10 of the prior art is schematically shown. It includes generally parallel spaced ground planes 12 and 14 defining a cavity 16 therebetween. The upper ground plane 12 has a slot 18. Located between the two ground planes is a stripline 20 of a conductive material which extends generally normal to the length dimension of the slot, and to which is connected a monopole 22. The monopole 22 extends from the strip line 20 through the slot 18 at a central location of the slot orthogonal to the ground plane 12. Typically, the monopole is a quarter wave length measured from the stripline. Moreover, for a given resonant frequency and characteristic impedance, the dimensions of the cavity, stripline, slot and monopole can be readily determined from known reference or calculations.

FIG. 2 shown schematically a hybrid slot antenna 30 of the prior art, which includes the same elements as the full height monopole/slot antenna of FIG. 1 with the modification of a shortened monopole with a conductive disk or "top hat" 32 at the top thereof. For a given resonant frequency, characteristic impedance, and monopole height, the disk radius can be determined or calculated as with the other parameters also present on the full height monopole/slot antenna.

Figure 5:
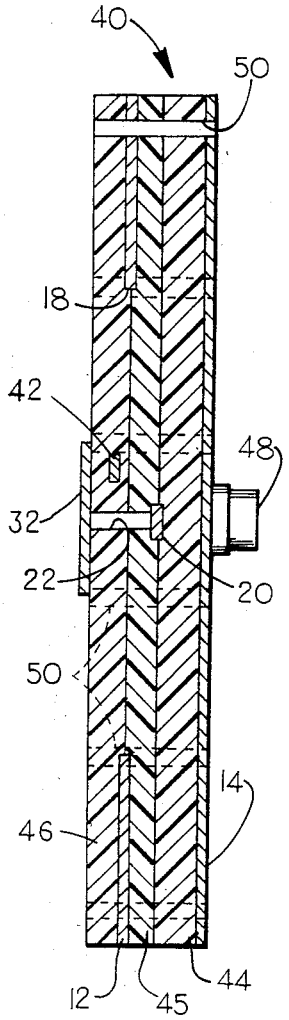
FIG. 5 is a view in section taken generally along the line 5—5 of FIG. 4.
Figure 6:
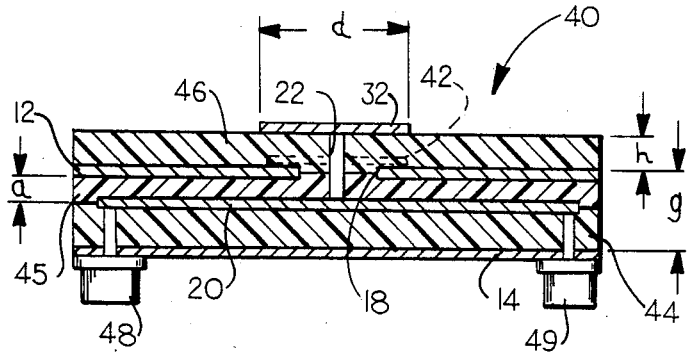
FIG. 6 is a view in section taken generally along the line 6—6 of FIG. 4.

A reduced height monopole/slot antenna 40 of the present invention is shown schematically in FIG. 3 and in more detail in FIGS. 4 through 6. As seen from the drawing, the stripline 20 is offset toward the upper ground plane 12, and the slot 18 is capacitively loaded across the width of the slot near the monopole as shown at 42.

With reference to FIGS. 4 through 6, the construction of the antenna of the present invention includes dielectric layers 44 and 45 between the ground planes 12 and 14, and a dielectric layer 46 between the upper ground plane 12 and the top hat 32, such that the upper surface of the dielectric layer 46 is substantially flush with the top hat to present a relatively flat uninterrupted surface. The stripline 20 is connected at each end to suitable connectors such as coaxial connectors 48, 49 on the bottom side of the antenna. Spaced conductive posts 50 extend through the layers and serve both to join the layers together and to define the perimeter of the cavity 16. These posts are conductively joined to the two ground planes. Although capacitance is shown across the slot at only one side of the monopole, additional capacitance could be applied at the other side of the monopole.

Figure 7:
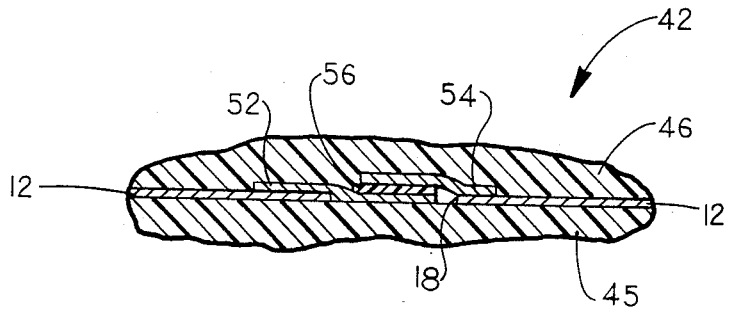
FIG. 7 is a generally sectional view showing a capacitor construcion which may be used with the antenna of the present invention.
Figure 8:
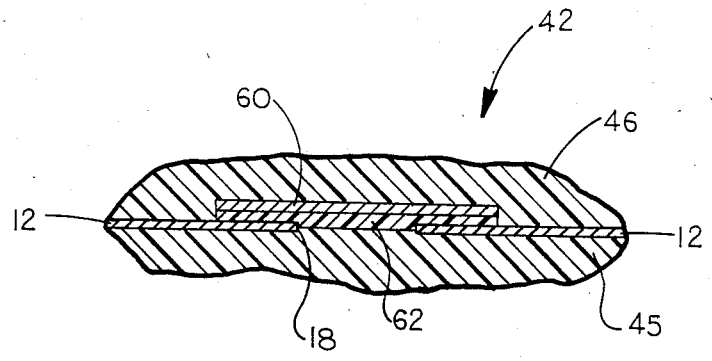
FIG. 8 is a view similar to FIG. 7 showing an alternate form of a capacitor construction that may be used with the antenna of the present invention.

FIGS. 7 and 8 are examples of capacitor constructions that can be used for the capacitance 42. As shown in FIG. 7, the capacitor includes a first conductive strip 52 connected to the upper ground plane 12 at one side of the slot, and a second conductive strip 54 connected to the upper ground plane at the other side of the slot. The conductive strips 52 and 54 overlap but are separated by a dielectric strip 56. In FIG. 8 an alternate form of capacitor construction includes a single conductive strip 60 that lies above the slot parallel to the upper ground plane 12 and overlaps the upper ground plane at each side of the slot. The conductive strip is spaced from the upper surface of the upper ground plane by a dielectric stip 62 which is configured to contact the upper surface of the dielectric 45 as well as the facing surfaces of the upper ground plane and the conductive strip.

Hence, the offsetting of the stripline and the capacitance loading of the slot are the two primary features of the present invention that produce significantly improved performance over known monopole/slot antennas. By way of explanation, shortening the monopole with capacitive top hat loading causes the input impedance of the antenna to be lower than that of the full height monopole. To obtain an acceptable input impedance for the antenna, the impedances of the monopole and slot, normalized to the stripline impedance, must have a reciprocal or complementary relationship. In other words, as the monopole height is reduced and its impedance reduced, the slot impedance must be increased in a corresponding way to keep this complementary relationship. The relationship is achieved, or at least very closely achieved, with the two modifications of offsetting the stripline and capacitively loading the slot.

To explain further, the slot appears as a series load to the stripline. Increasing the coupling between the stripline and the slot increases the series impedance presented. By offsetting the stripline toward the upper ground plane containing the slot, the coupling to the slot, and hence its series impendance, is increased. Thus, by offsetting the stripline an appropriate amount, the slot impedance may be made to very closely match the top hat loaded monopole impedance, at least at and near resonant frequency.

Although the offsetting of the stripline produces impedance responses of the monopole and slot that match well near resonance (in a reciprocal or complementary sense), they depart off resonance. The additional capacitance loading of the slot by way of the capacitance 42 makes it possible to achieve a very close reciprocal impedance match over a broad bandwidth.

By way of example, a reduced height monopole/slot antenna of the present invention was constructed for a resonant frequency of 0.95 GHz with the following dimensions with reference to FIGS. 4 through 6:

the spacing g between the upper and lower ground planes equals 0.188 inches (0.48 cm);

the distance a between the stripline and the upper ground plane equals 0.031 inches (0.08 cm);

the width Wa of the stripline equals 0.040 inches (0.10 cm);

the height h of the monopole above the upper ground plane equals 0.250 inches (0.64 cm);

the diameter d of the top hat equals 1.25 inches (3.18 cm);

the slot width Ws equals 0.625 inches (1.59 cm);

the slot length l equals 3 inches (7.62 cm);

the spacing s of the posts 50 equals 1 inch (2.54 cm) such that the cavity dimensions are 3 inches (7.62 cm) wide by 3 inches long (7.62 cm) by 0.188 inches (0.48 cm) thick; and the capacitance strip 42 is of the design shown in FIG. 7.

With this antenna, it was found that the slot and monopole impedances matched well from very low frequencies up to approximately 1.2 GHz. Moreover, the antenna showed a VSWR of 2 to 1 or less from D.C. to 1.2 GHz. Also, radiation patterns of the antenna were measured in an anechoic chamber. The antenna was mounted on a thirty inch diameter ground plane, and radiation patterns were made at frequencies from 0.2 to 1.7 GHz in 0.2 GHz steps. A null depth of at least 15 db below peak amplitude was maintained over this range, with the largest null depth of 28 db at 0.95 GHz.

To determine the parameters for the reduced height monopole/slot antenna of the present invention, first the resonant frequency for the antenna is selected. The monopole height is selected based on physical constraints imposed by the antenna's application. For example, if the antenna is to be used on a missile, the height of the monopole will be restricted so as not to protrude above the missile surface. The cavity and slot width dimensions are determined using known principles based on the resonant frequency for the antenna. With the resonant frequency and monopole height as given conditions, the radius of the top hat is calculated based on known principles. In other words, for a given monopole height, the disk size is calculated such that the capacitance between the end of the monopole and the upper ground plane as created by the top hat, tunes out the reactance created by the shortened monopole.

Next the monopole (including the top hat) impedance response is measured. This may be done by either building a model and measuring it by applying conductive tape over the slot, or by developing an electric model for the antenna and calculating the impedance response. Once the monopole impedance response is determined, the amount of stripline offset toward the upper ground plane is determined such that the slot impedance, at resonant frequency and measured without the monopole, is approximately the complement of the top hat loaded monopole impedance at resonant frequency. This also may be accomplished by building a model and positioning the stripline until the complement impedance at resonant frequency is obtained. In determining the offset, the slot impedance is a function of both the offset and the width of the stripline. Therefore, as various amounts of offset are tried, the width of the stripline must be changed to maintain the characteristic impedance, for there is a correct stripline width for each offset position. The stripline width Wa for the offset stripline of the present invention may be determined as the average of the stripline widths W1 and W2, where W1 is the appropriate stripline width for a full height monopole/slot antenna where the ground plane spacing is twice the spacing between the offset stripline and the upper ground plane of the present invention, and W2 is the appropriate stripline width for a full height monopole/slot antenna where the ground plane spacing is twice the spacing between the offset stripline and the lower ground plane of the present invention.

Thus, for each amount of offset of the stripline toward the upper ground plane, an appropriate stripline width Wa may be determined. A stripline offset, with appropriate width Wa, is selected to obtain a slot impedance that is the complement of the top hat loaded monopole impedance at resonant frequency as previously explained.

Next the amount of capacitance for the capacitor 42 is determined as a tradeoff with the length of slot 18 to obtain a complementary impendance match of the slot versus the loaded monopole over a wide frequency range. In other words, the capacitance and slot length are selected to closely approximate a complementary impedance curve.

In the alternative, an electrical model may be designed for the antenna, and the various parameters calculated.

There are several known or possible uses for the antenna of the present invention. It can be used as a single element antenna to provide excellent impedance bandwidth. It provides an exceptionally stable unidirectional pattern, and the direction of maximum radiation can be changed 180° by interchanging the feed and termination ports to the stripline. These properties make the antenna useful as to a communications antenna. The null in the radiation pattern can be used to provide covertness or to eliminate an interfering signal.

The stable radiation pattern makes the antenna attractive for direction finding applications. A pair of antennas could be used to sample an incoming wave front for amplitude and for phase to determine direction of arrival. The pattern directional properties can be used to eliminate 180° ambiguities in direction of arrival that exist in direction finding systems. The pattern direction can be reversed by switching the driven and terminated ports. The amplitude of response can be monitored to determine which half plane the signal is coming from.

The antenna is also useful as an element in a phased array. The elements can be arrayed to provide nulls that reinforce the element pattern null or provide additional nulls. Because of the wide bandwidth of nearly constant input impedance, the element excitation currents can be maintained at their desired values, and hence the array pattern is preserved, over a wide range of frequencies. If the antenna is used as an element in an end fire array, each element will "look" into the null of the element in front of it, and mutual coupling between elements is reduced by 15 dB or more. This is important because mutual coupling is a factor that can reduce the bandwidth of an array, and is nearly eliminated by using the antenna of the present invention as an element.

Thus, there has been described a reduced height monopole/slot antenna representing substantial improvements over previously known monopole/slot antennas, and which because of its improved characteristics, is particularly suitable for a variety of known and possible uses.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

What is claimed is:

1. In a monopole/slot antenna having generally parallel spaced ground planes, the upper one of which has a slot therein, a stripline located between the ground planes, and a monopole extending from the stripline through said slot generally orthogonally to the upper ground plane and being top hat loaded at the outer end thereof, said improvement comprising means for offsetting said stripline toward the slotted ground plane, and means for capacitively loading said slot, said capacitance loading being in addition to any capacitance coupling between the top hat loaded monopole and the upper ground plane.

2. In the antenna of claim 1 wherein said means for capacitively loading said slot further comprises capacitance means connected across the narrow dimension of said slot.

3. In the antenna of claim 2 wherein said capacitance means is connected across the narrow dimension of said slot at one side of said monopole.

4. In the antenna of claim 2 wherein said capacitance means is connected across the narrow dimension of said slot at opposite sides of said monopole.

5. In the antenna of claim 1 wherein for a given resonant frequency, said stripline offset is such that the impedance of the slot at resonant frequency is approximately the complement to the impedance of the top hat loaded monopole at that frequency.

6. In the antenna of claim 5 wherein the width of said offset stripline is approximately the average of the stripline widths W1 and W2, where W1 is the appropriate stripline width for a full height monopole slot antenna where the ground plane spacing is twice the spacing between the offset stripline and the upper ground plane, and W2 is the appropriate stripline width for a full height monopole/slot antenna where the ground plane spacing is twice the spacing between the offset stripline and the lower groundplane.

7. In the antenna of claim 1 wherein the length of said slot and the capacitance of said capacity loading are such as to produce an impedance curve for said loaded slot that is approximately the complement of the impedance curve of the top hat loaded monopole for the antenna bandwidth over which the antenna is to operate.

8. In a monopole/slot antenna having generally parallel spaced ground planes, the upper one of which has a slot therein, a stripline located between the ground planes, and a monopole extending from the stripline through said slot generally orthogonally to the upper ground plane and being top hat loaded at the outer end thereof, said improvement comprising means for offsetting said stripline toward said slotted ground plane such that the impedance of the slot at resonant frequency is approximately the complement to the impedance of the top hat loaded monopole at that frequency, and capacitance means connected across said slot, the length of said slot and the capacitance of said capacitance means being selected to produce an impedance curve for said loaded slot that is approximately the complement of the impedance curve of the top hat loaded monopole for the antenna bandwidth over which the antenna is to operate.

9. In the antenna of claim 8 wherein the width of said offset stripline is approximately the average of the widths W1 and W2, where W1 is the appropriate stripline width for a full height monopole slot antenna where the ground plane spacing is twice the spacing between the offset stripline and the upper ground plane, and W2 is the appropriate stripline width for a full height monopole/slot antenna where the ground plane spacing is twice the spacing between the offset stripline and the lower ground plane.

* * * * *